US006059336A

United States Patent [19]

Meronek

[11] Patent Number: 6,059,336

[45] Date of Patent: May 9, 2000

[54] HYDRAULICALLY ACTUATED MECHANICAL COUPLER

[75] Inventor: Richard A. Meronek, Houston, Tex.

[73] Assignee: Kvaernet Oilfield Products, Houston, Tex.

[21] Appl. No.: 08/995,833

[22] Filed: Dec. 22, 1997

[51] Int. Cl.[7] ..... E21B 23/00

[52] U.S. Cl. ..... 294/88; 294/86.29; 294/86.33; 405/223.1; 405/224; 166/178; 279/57

[58] Field of Search ..... 294/86.26, 86.29, 294/86.3, 86.32, 86.33, 86.15, 88, 100; 405/223.1, 224, 224.1, 224.2, 224.3, 224.4; 166/301, 178, 242.7; 279/50, 43, 57

[56] References Cited

U.S. PATENT DOCUMENTS

| | | | |
|---|---|---|---|
| 2,507,127 | 5/1950 | True | 294/88 |
| 3,739,846 | 6/1973 | Beson | 166/89 |
| 3,741,601 | 6/1973 | Dudley | 294/86.31 |
| 3,853,699 | 12/1974 | Frisch et al. | 294/88 |
| 3,905,634 | 9/1975 | Johnson et al. | 294/86.1 |
| 3,965,977 | 6/1976 | Beson | 166/88 |
| 4,374,630 | 2/1983 | Fraser, Jr. | 504/224 |
| 4,544,521 | 10/1985 | Millot et al. | 294/86.17 |
| 4,664,558 | 5/1987 | De Meio et al. | 405/224 |
| 4,703,774 | 11/1987 | Seehausen | 137/614 |
| 4,709,725 | 12/1987 | Morrison | 137/614 |
| 4,796,922 | 1/1989 | Prichard | 285/26 |
| 4,852,611 | 8/1989 | Knerr et al. | 137/595 |
| 5,158,142 | 10/1992 | Miszewski et al. | 166/377 |
| 5,178,248 | 1/1993 | Lombardi et al. | 294/88 |
| 5,580,114 | 12/1996 | Oalmer | 294/86.3 |

FOREIGN PATENT DOCUMENTS

| | | | |
|---|---|---|---|
| 0595145 | 2/1978 | U.S.S.R. | 294/88 |
| 2097885 | 4/1982 | United Kingdom . | |
| 2132728 | 4/1982 | United Kingdom . | |
| 2184508 | 11/1986 | United Kingdom . | |
| 2195158 | 9/1987 | United Kingdom . | |

*Primary Examiner*—Dean J. Kramer
*Assistant Examiner*—Paul Chin
*Attorney, Agent, or Firm*—Wendy K. Buskop; Bayko Gibson et al.

[57] ABSTRACT

A connector unit is disclosed which comprises a shaft, a plurality of collet fingers, and a sleeve. The plurality of collet fingers are peripherally positioned against the generally cylindrical outside surface of the shaft adjacent the lower end of the shaft. The sleeve has an upper end, a lower end, and a generally cylindrical inside surface positioned peripherally around the shaft. The sleeve is provided with a radially inwardly extending annular flange extending from its inside surface between its upper end and its lower end which forms a seal with the generally cylindrical outside surface of the shaft. An upper annular chamber is formed between the generally cylindrical outside surface of the shaft and the generally cylindrical inside surface of the sleeve above the radially inwardly extending flange and a lower annular chamber is formed between the generally cylindrical outside surface of the shaft and the generally cylindrical inside surface of the sleeve below the radially inwardly extending flange. The shaft further defines first hydraulic fluid passage opening into the upper hydraulic chamber and a second hydraulic fluid passage opening into the lower hydraulic chamber. Supply of hydraulic fluid through the first hydraulic fluid passage to the upper hydraulic chamber moves the sleeve from a first position in which the collet fingers are in an unlatched position with the lower ends of the collet fingers extending past the lower end of the sleeve to a latched position in which the lower ends of the collet fingers are positioned adjacent an inside surface of the sleeve. Also disclosed is a subsea tool which employs the connector.

23 Claims, 3 Drawing Sheets

HYDRAULICALLY ACTUATED MECHANICAL COUPLER

BACKGROUND OF THE INVENTION

In one aspect, this invention relates to a hydraulically actuated mechanical connector unit. In another aspect, this invention relates to a collet finger gripper. In yet another aspect, this invention relates to a tool suitable for subsea use which employs a collet finger gripper.

Subsea tools and subsea christmas trees often employ mechanical latching mechanisms which rely on push-pull longitudinal forces for actuation. The mechanisms usually employ posts which extend upwardly from the latch mechanism in the equipment containing the latch. In order to be able to both pull and push on the post, it is necessary to latch to the post. Because the post may be situated several hundred feet subsea, it is necessary to accomplish the latching operation remotely.

An improved connector for remotely latching a tool to subsea equipment would be very desirable.

SUMMARY OF THE INVENTION

In one embodiment of the invention, there is provided a connector unit comprising a shaft, a plurality of collet fingers, and a sleeve. The shaft has an upper end, a lower end, a longitudinal axis, a generally cylindrical outside surface, and an annular groove defined in the generally cylindrical outside surface adjacent to the lower end of the shaft. The plurality of collet fingers are peripherally positioned against the generally cylindrical outside surface of the shaft adjacent to the lower end of the shaft. Each collet finger has a radially inwardly extending upper ridge near an upper end ofthe collet finger which is positioned in the annular groove of the shaft and a radially inwardly extending lower ridge near a lower end of each collet finger which is positioned at a spaced apart distance beneath the lower end of the shaft. The sleeve has an upper end, a lower end, and a generally cylindrical inside surface positioned peripherally around the shaft. An annulus is defined between the shaft and the sleeve. A lower portion of the generally cylindrical inside surface of the sleeve contacts an outer face of each collet finger to retain the generally radially inwardly extending upper ridge on each collet finger in the groove on the shaft. A radially extending annular flange means is provided in the annulus. An upper annular chamber is formed between the generally cylindrical outside surface of the shaft and the generally cylindrical inside surface of the sleeve above the radially extending annular flange means and a lower annular chamber is formed between the generally cylindrical outside surface of the shaft and the generally cylindrical inside surface of the sleeve below the radially extending annular flange means. Means is provided for sealing an upper end of the upper annular chamber between the shaft and the sleeve, thereby forming an upper hydraulic chamber; and for sealing a lower end of the lower annular chamber between the shaft and the sleeve, thereby forming a lower hydraulic chamber. The shaft further defines first hydraulic fluid passage opening into the upper hydraulic chamber and a second hydraulic fluid passage opening into the lower hydraulic chamber. Supply of hydraulic fluid through one of the hydraulic fluid passages moves the sleeve from a first position in which the collet fingers are in an unlatched position with the lower ends of the collet fingers extending past the lower end of the sleeve to a latched position in which the lower ends of the collet fingers are positioned adjacent an inside surface of the sleeve.

The just described connector is particularly useful when used on a subsea tool as employed by the oil and gas industry. The connector can be latched to a shaft which can then be pushed or pulled to actuate subsea latches which connect subsea equipment such as wellheads, christmas trees, and tools to each other.

In another embodiment of the invention, there is provided a subsea tool. The tool comprises a tool body having an upper end, a lower end, and an axial passage extending therethrough. A connector unit, which can be as described above, is mounted to the outside of the tool body for axially connecting to a shaft extending upwardly from equipment situated beneath the tool. Preferably, the shaft of the connector unit is driven up or down by a hydraulic piston unit operatively attached to the shaft, such as by a connecting rod or an annular flange mounted to the outside of the tool body.

DETAILED DESCRIPTION OF THE INVENTION

Figure 1:
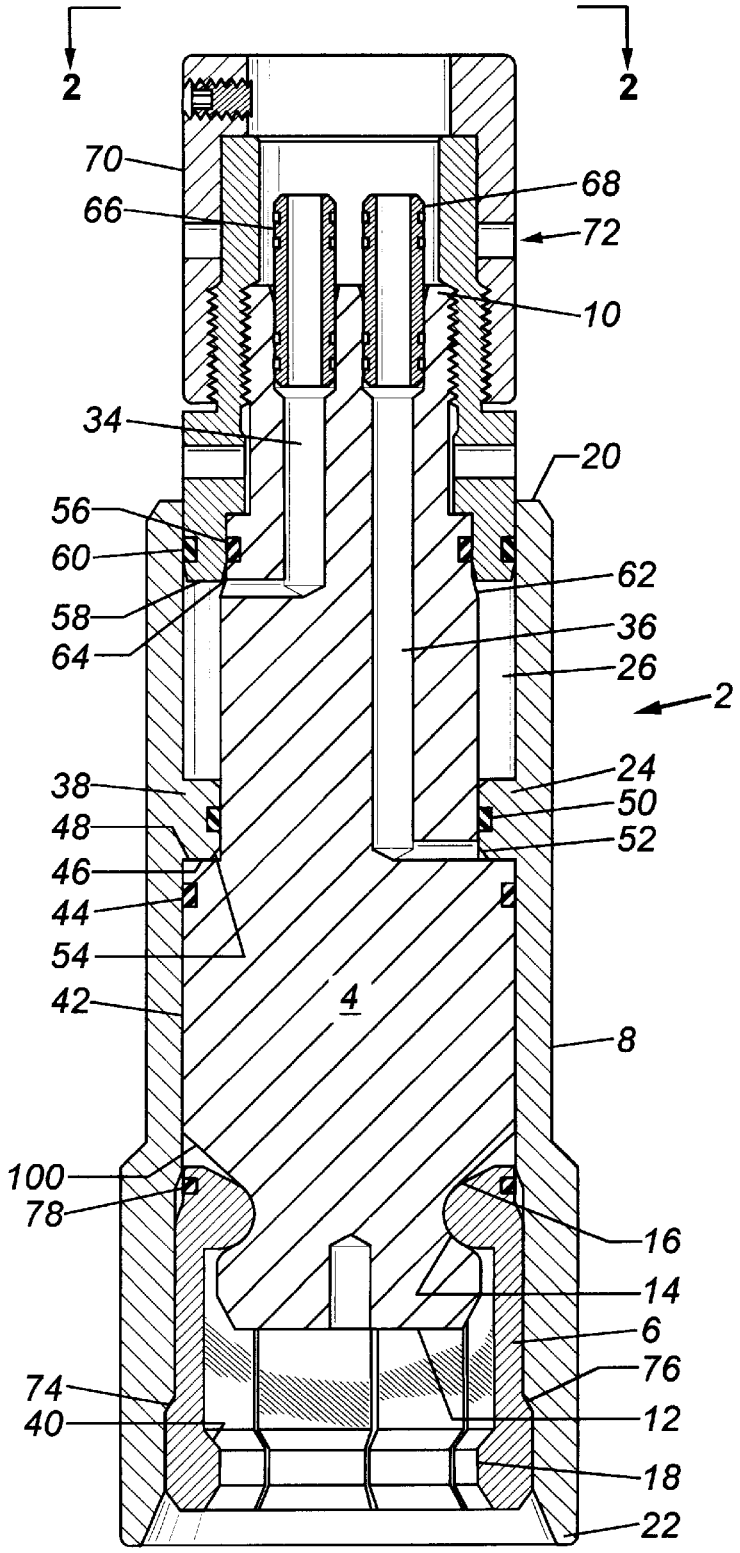
FIG. 1 is a cross sectional view of a connector according to one embodiment of the invention
Figure 2:
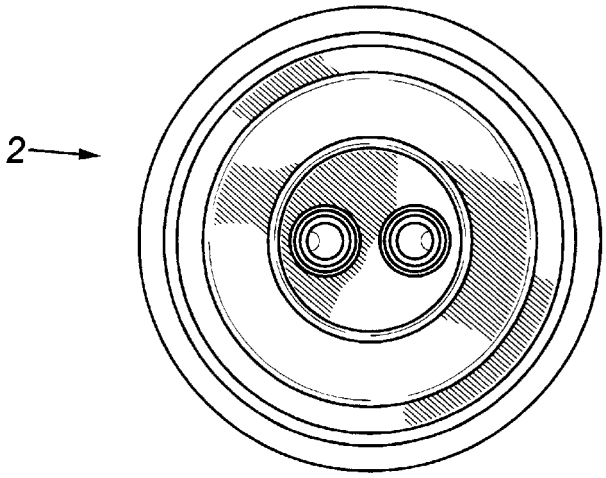
FIG. 2 is an end view of the connector along the lines indicated in FIG. 1.
Figure 3:
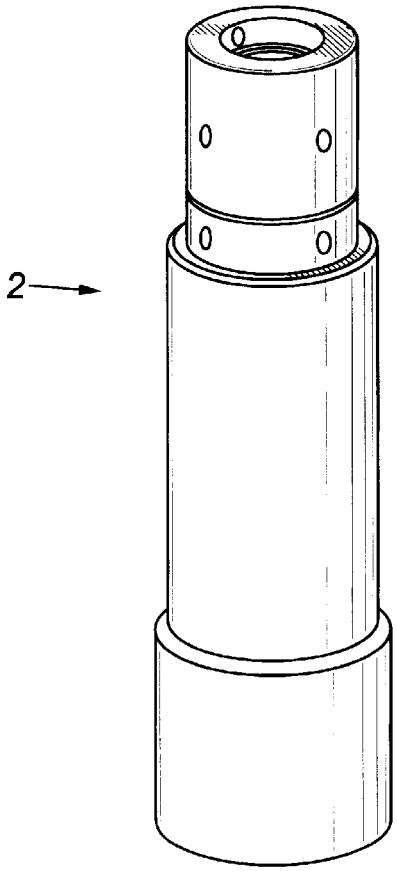
FIG. 3 is a pictorial representation of the connector of FIG. 1.

In one embodiment of the invention, there is provided a connector unit 2 comprising a shaft 4, a plurality of collet fingers 6, and a sleeve 8. The shaft 4 has an upper end 10, a lower end 12, a longitudinal axis, a generally cylindrical outside surface, and an annular groove 14 defined in the generally cylindrical outside surface adjacent to the lower end of the shaft 4. The plurality of collet fingers 6 are peripherally positioned against the generally cylindrical outside surface of the shaft 4 adjacent to the lower end of the shaft. Each collet finger has a radially inwardly extending upper ridge 16 near an upper end of the collet finger which is positioned in the annular groove of the shaft 4 and a radially inwardly extending lower ridge 18 near a lower end of each collet finger which is positioned at a spaced apart distance beneath the lower end of the shaft. The sleeve has an upper end 20, a lower end 22, and a generally cylindrical inside surface positioned peripherally around the shaft. An annulus 100 is defined between the shaft and the sleeve. A lower portion of the generally cylindrical inside surface of the sleeve contacts an outer face of each collet finger to retain the generally radially inwardly extending upper ridge on each collet finger in the groove on the shaft. A radially extending annular flange means is provided in the annulus. An upper annular chamber 26 is formed between the generally cylindrical outside surface of the shaft 4 and the generally cylindrical inside surface of the sleeve above the radially extending annular flange means and a lower annular chamber 52 is formed between the generally cylindrical outside surface of the shaft and the generally cylindrical inside surface of the sleeve below the radially extending annular flange means. Means 60 is provided for sealing an upper end of the upper annular-chamber between the shaft and the sleeve, thereby forming an upper hydraulic chamber; and a means 44 is provided for sealing a lower end of the lower annular chamber between the shaft and the sleeve, thereby forming a lower hydraulic chamber. The shaft further defines first hydraulic fluid passage 34 opening into the upper hydraulic chamber and a second hydraulic fluid passage 36 opening into the lower hydraulic chamber. Supply of hydraulic fluid through one of the hydraulic fluid passages moves the sleeve from a first position in which the collet fingers are in an unlatched position with the lower ends of the collet fingers extending past the lower end of the sleeve (not shown) to a latched position in which the lower ends of the collet fingers are positioned adjacent an inside surface of the sleeve.

The annular flange means can be fixed attached to either the outside surface of the shaft or the inside surface of the sleeve. When the flange is attached to the shaft, supply of fluid to the lower chamber urges the sleeve downwardly over the collet fingers to the latched position, whereas supply of fluid to the upper chamber (and exhaust of fluid from the lower chamber), urges the sleeve upwardly to the unlatched position. Preferably, the annular flange means comprises a radially inwardly extending annular flange 38 extending from the inside surface of the sleeve between its upper end and its lower end which forms a seal with the generally cylindrical outside surface of the shaft. In this embodiment supply of fluid to through the first hydraulic fluid passage to the upper hydraulic chamber moves the sleeve from the first position (latched) to the second position (unlatched).

Preferably, the lower ridge is contoured to latch to an annular groove around a post upper end. (See FIG. 4). The post will generally constitute a linkage extending to a longitudinally actuated latch for equipment situated beneath the connector unit.

To permit the connector unit to disengage from the post on longitudinal movement away from the post, it is preferred that the lower ridge of each collet finger has an inwardly and upwardly facing tapered inner surface 40 to permit the fingers to disengage from the post on upward movement of the connector unit when the sleeve is in the unlatched position. Disengagement is further facilitated by providing the upper ridge 16 of each collet finger with a rounded shape and by defining the groove 14 in the shaft with a rounded surface so that each collet finger can pivot in the groove.

In a preferred embodiment, the means for sealing a lower end of the lower annular chamber between the shaft and the sleeve comprises an annular flange 42 extending radially outwardly from the generally cylindrical surface of the shaft at a position above the annular groove in the shaft. The annular flange on the shaft has a generally cylindrical outer surface having an outside diameter which is closely received by an inside diameter of the sleeve. The flange carries a seal means 44, such as an o-ring, on the generally cylindrical outside surface for forming a sliding seal between the generally cylindrical outer surface of the shaft and the inner surface of the sleeve. The flange defines an upper annular surface 46 which forms the lower end of the upper hydraulic chamber. The radially inwardly extending flange of the sleeve defines a lower annular surface 48 which forms the lower end of the upper hydraulic chamber.

The second hydraulic fluid passage 36 opens preferably onto the outer surface of the shaft at a position closely adjacent to the upper annular surface of the flange of the shaft. The radially inwardly extending annular flange of the sleeve preferably further defines a generally cylindrical inside surface which is positioned closely adjacent to the generally cylindrical outside surface of the shaft. This generally cylindrical inside surface carries a seal means 50, such as an o-ring seal, for forming a sliding seal between the generally cylindrical outer surface of the shaft and the generally cylindrical inside surface of the flange of the sleeve. The the upper annular surface of the flange on the shaft is positioned closely adjacent to the lower annular surface of the flange on the sleeve when the unit is in the latched position. The flange of the sleeve preferably further defines a beveled surface 62 positioned between the generally annular lower surface and the generally cylindrical inner surface to form an annular lead-in 54 at the lower end of the lower hydraulic chamber. The second hydraulic fluid passage empties into the annular lead-end when the connector unit is in the latched position.

The means for sealing an upper end of the upper annular chamber between the shaft and the sleeve preferably comprises a ring 56 sealingly attached to the generally cylindrical outside surface of the shaft. The ring has a lower annular wall 58 which defines the upper end of the upper hydraulic chamber and a generally cylindrical outer surface positioned closely adjacent to the generally cylindrical inside surface of the sleeve. The generally cylindrical outside surface of the ring carrying a seal means 60, such as an o-ring seal, for forming a sliding seal between the generally cylindrical outer surface of the ring and the generally cylindrical inside surface of the sleeve. Preferably, the ring is threaded to the shaft.

In the preferred embodiment, the first hydraulic fluid passage 34 opens onto the outer surface of the shaft at a position closely adjacent to the lower annular surface of the ring. The upper annular surface of the flange on the sleeve is positioned closely adjacent to the lower annular surface of the ring on the shaft when the unit is in the unlatched position (not shown). The ring further defines a beveled surface 62 positioned between the generally annular lower surface of the ring and the generally cylindrical inner surface of the ring to form an annular lead-in 64 at the upper end of the upper hydraulic chamber. The first hydraulic fluid passage empties into the annular lead-end when the connector unit is in the unlatched position.

In the illustrated embodiment, the first and second hydraulic fluid passages open onto the upper end of the shaft. A first axially extending tubular hydraulic fitting 66 is connected to the upper end of the shaft and forms a fluid flow path leading from the first hydraulic fluid passage. A second axially extending tubular hydraulic fitting 68 is connected to the upper end of the shaft and forms a fluid flow path leading from the second hydraulic fluid passage. The second hydraulic tubular fitting is positioned parallel to the first tubular hydraulic fitting. A a tubular housing element 70 is attached to the upper end of the shaft and extends axially from the upper end to defning a housing chamber containing the first tubular fitting and the second tubular fitting, The tubular housing element 70 has an upper end which is positioned above an upper end of the first tubular fitting and an upper end of the second tubular fitting. Preferably, a latch means 72 is positioned on an outer surface of the tubular housing element for engaging a reciprocal latch means on a quick-connect hydraulic fitting.

In a preferred embodiment, a generally frustoconical downwardly facing inner surface 74 is defined near the lower end of the sleeve. A generally frustoconical upwardly facing outer surface 76 is defined between the upper end and the lower end of each collet finger. The generally frustoconical downwardly facing inner surface near the lower end of the sleeve contacts the generally frustoconical upwardly facing outer surface of each collet finger when the connector unit is in the latched position. A ring-shaped biasing means 78, such as an o-ring, is also preferably provided positioned circumferentially around an outer surface of the plurality of collet fingers near the upper end thereof.

Figure 4:
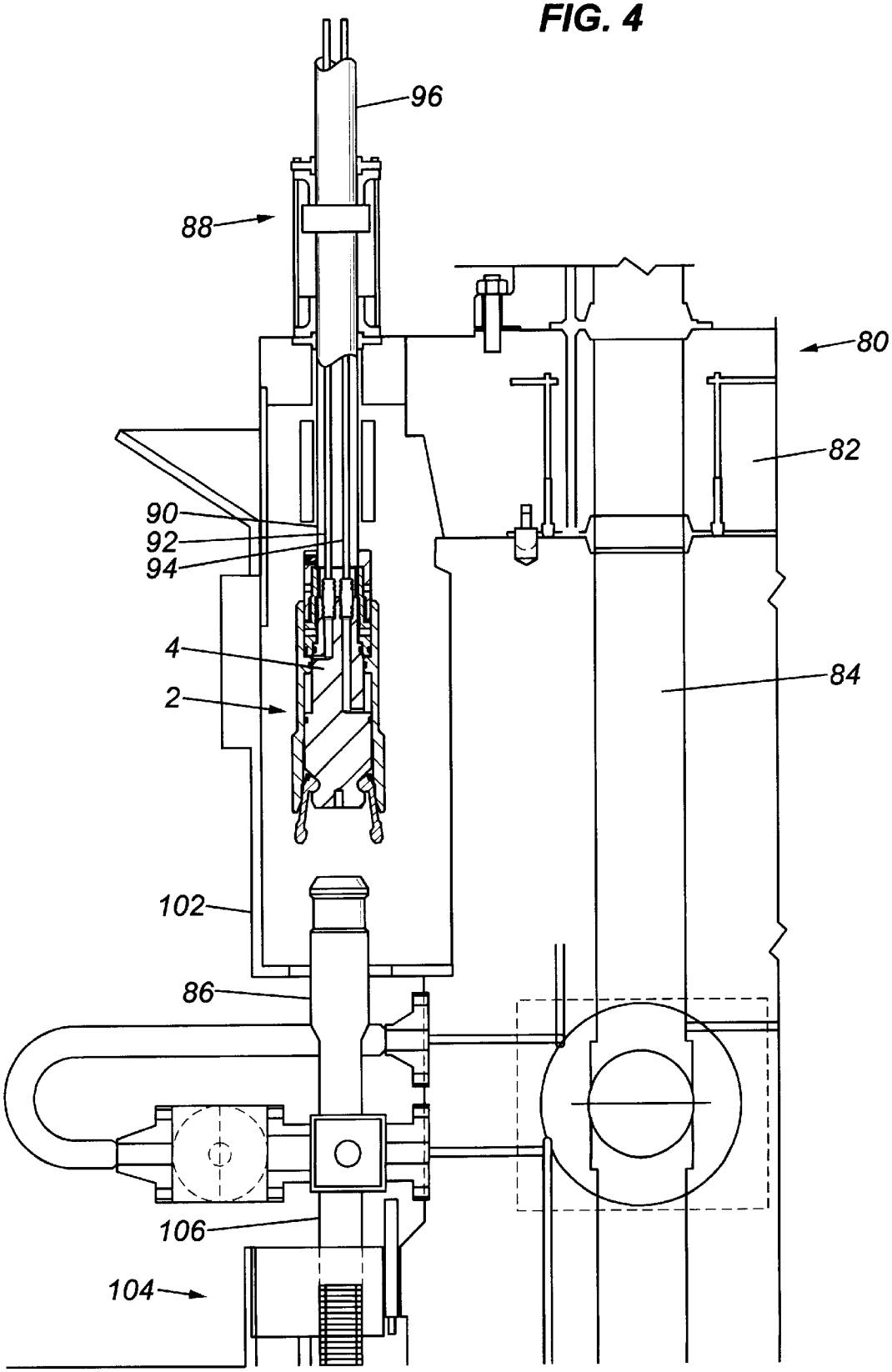
FIG. 4 is a cross sectional view of a portion of a subsea tool employing the connector of FIG. 1.

In another embodiment of the invention, there is provided a subsea tool 80, a portion of which is shown in FIG. 4. The tool comprises a tool body 82 having an upper end, a lower end, and an axial passage 84 extending therethrough. A connector unit 2, which can be as described above, is mounted to the outside of the tool body for axially connecting to a shaft 86 extending upwardly from equipment situated beneath the tool.

Preferably, the tool comprises a hydraulic piston unit 88 mounted on the outer surface of the tool body at a position vertically above the connector unit. A connecting rod 90 connects the piston of the hydraulic piston unit with the upper end of the shaft. Preferably, the connecting rod further defines a first hydraulic fluid passage 92 sealingly connected to the first hydraulic fluid passage of the shaft and a second hydraulic fluid passage sealingly connected to the second hydraulic fluid passage of the shaft. More preferably, the connecting rod extends through the piston of the hydraulic piston unit and has an upper end 96 positioned above the hydraulic piston unit. The first hydraulic fluid passage and the second hydraulic fluid passage open onto the upper end of the connecting rod, where they can be easily accessed for attachment to hydraulic fluid control lines.

The shaft 4 is preferably mounted to the outside of the tool body for longitudinal movement. In one embodiment, the tool body has a generally cylindrical outside surface. A flange is slidably mounted to the generally cylindrical outside surface of the tool body. The shaft is fixedly attached to the flange. In this manner, longitudinal movement of the connecting rod causes longitudinal movement of the shaft.

By way of example, the tool can be used in combination with a subsea christmas tree 104. The tree can be described as having a tubular main body 102 with a longitudinal axis 106 and includes a linkage shaft 86 positioned outside of the tubular main body parallel to the longitudinal axis. Each of the tubular main body and the linkage shaft each have an upper end. The subsea tool is positioned on the upper end of the tubular main body and the connector unit is attached to the upper end of the linkage shaft.

While certain preferred embodiments of the invention have been described herein, the invention is not to be construed as being so limited, except to the extent that such limitations are found in the claims.

What is claimed is:

1. A connector unit comprising a shaft having an upper end, a lower end, a longitudinal axis, a generally cylindrical outside surface, and an annular groove defined in the generally cylindrical outside surface adjacent to the lower end of the shaft;

a plurality of collet fingers peripherally positioned against the generally cylindrical outside surface of the shaft adjacent to the lower end of the shaft, each collet finger having a radially inwardly extending upper ridge near an upper end of the collet finger which is positioned in the annular groove of the shaft and a radially inwardly extending lower ridge near a lower end of each collet finger which is positioned at a spaced apart distance beneath the lower end of the shaft;

a sleeve having an upper end, a lower end, and a generally cylindrical inside surface positioned peripherally around the shaft, an annulus being defined between the generally cylindrical inside surface of the sleeve and the generally cylindrical outside surface of the shaft, wherein a lower portion of the generally cylindrical inside surface of the sleeve contacts an outer face of each collet finger to retain the generally radially inwardly extending upper ridge on each collet finger in the groove on the shaft;

annular flange means radially positioned in the annulus to define an upper annular chamber between the generally cylindrical outside surface of the shaft and the generally cylindrical inside surface of the sleeve above the annular flange means and a lower annular chamber between the generally cylindrical outside surface of the shaft and the generally cylindrical inside surface of the sleeve below the annular flange means;

means for sealing an upper end of the upper annular chamber between the shaft and the sleeve, thereby forming an upper hydraulic chamber; and means for sealing a lower end of the lower annular chamber between the shaft and the sleeve, thereby forming a lower hydraulic chamber;

wherein the shaft further defines first hydraulic fluid passage opening into the upper hydraulic chamber and a second hydraulic fluid passage opening into the lower hydraulic chamber;

whereby supply of hydraulic fluid through one of the first hydraulic fluid passage or the second hydraulic fluid passage moves the sleeve from a first position in which the collet fingers are in an unlatched position with the lower ends of the collet fingers extending past the lower end of the sleeve to a latched position in which the lower ends of the collet fingers are positioned adjacent an inside surface of the sleeve.

2. A connector unit as in claim 1 wherein the annular flange means comprises a radially inwardly extending annular flange extending from the inside surface of the sleeve between its upper end and its lower end which forms a seal with the generally cylindrical outside surface of the shaft, whereby supply of fluid to through the first hydraulic fluid passage to the upper hydraulic chamber moves the sleeve from the first position to a second position.

3. A connector unit as in claim 2 wherein the lower ridge is contoured to latch to an annular groove around a post upper end.

4. A connector unit as in claim 2 wherein the lower ridge of each collet finger has an inwardly and upwardly facing tapered inner surface to permit the fingers to disengage from a post on upward movement of the connector unit when the sleeve is in the unlatched position.

5. A connector unit as in claim 2 wherein the upper ridge of each collet finger is rounded and the groove in the shaft is defined by a rounded surface so that each collet finger can pivot in the groove.

6. A connector unit as in claim 1 wherein the means for sealing a lower end of the lower annular chamber between the shaft and the sleeve comprises an annular flange extending radially outwardly from the generally cylindrical surface of the shaft at a position above the annular groove in the shaft, said annular flange on the shaft having a generally cylindrical outer surface having an outside diameter which is closely received by an inside diameter of the sleeve and carrying a seal means on the generally cylindrical outside surface for forming a sliding seal between the generally cylindrical outer surface of the shaft and the inner surface of the sleeve, said flange defining an upper annular surface which forms the lower end of the lower hydraulic chamber.

7. A connector unit as in claim 6 wherein the radially inwardly extending flange of the sleeve defines a lower annular surface which form the upper end of the lower hydraulic chamber.

8. A connector unit as in claim 7 wherein the second hydraulic fluid passage opens onto the outer surface of the shaft at a position closely adjacent to the upper annular surface of the flange of the shaft.

9. A connector unit as in claim 8 wherein radially inwardly extending annular flange of the sleeve further defines a generally cylindrical inside surface which is positioned closely adjacent to the generally cylindrical outside surface of the shaft, said generally cylindrical inside surface carrying a seal means for forming a sliding seal between the generally cylindrical outer surface of the shaft and the generally cylindrical inside surface of the flange of the sleeve.

10. A connector unit as in claim 9 wherein the upper annular surface of the flange on the shaft is positioned closely adjacent to the lower annular surface of the flange on the sleeve when the unit is in the latched position, and the flange of the sleeve further defines a beveled surface positioned between the generally annular lower surface and the generally cylindrical inner surface, thereby forming an annular lead-in at the upper end of the lower hydraulic chamber, and the second hydraulic fluid passage empties into the annular lead-end when the connector unit is in the latched position.

11. A connector unit as in claim 1 wherein means for sealing an upper end of the upper annular chamber between the shaft and the sleeve comprises a ring sealingly attached to the generally cylindrical outside surface of the shaft, said ring having a lower annular wall which defines the upper end of the upper hydraulic chamber and a generally cylindrical outer surface positioned closely adjacent to the generally cylindrical inside surface of the sleeve, the generally cylindrical outside surface of the ring carrying a seal means for forming a sliding seal between the generally cylindrical outer surface of the ring and the generally cylindrical inside surface.

12. A connector unit as in claim 11 wherein the ring is threaded to the shaft.

13. A connector unit as in claim 11 wherein the first hydraulic fluid passage opens onto the outer surface of the shaft at a position closely adjacent to the lower annular surface of the ring.

14. A connector unit as in claim 13 wherein the upper annular surface of the flange on the sleeve is positioned closely adjacent to the lower annular surface of the ring on the shaft when the unit is in the unlatched position, and the ring further defines a beveled surface positioned between the generally annular lower surface and the generally cylindrical inner surface, thereby forming an annular lead-in at the upper end of the upper hydraulic chamber, and the first hydraulic fluid passage empties into the annular lead-end when the connector unit is in the unlatched position.

15. A connector unit as in claim 1 wherein the first hydraulic fluid passage opens onto the upper end of the shaft and the second hydraulic fluid passage opens onto the upper end of the shaft, said connector unit further comprising a first tubular hydraulic fitting connected to the upper end of the shaft and extending axially therefrom, said first tubular fitting forming a fluid flow path leading from the first hydraulic fluid passage;

a second tubular hydraulic fitting connected to the upper end of the shaft and extending axially therefrom, said second tubular fitting forming a fluid flow path leading from the second hydraulic fluid passage and being positioned parallel to the first tubular hydraulic fitting; and a tubular housing element attached to the upper end of the shaft and extending axially therefrom and defining a housing chamber containing the first tubular fitting and the second tubular fitting, said tubular housing element having an upper end which is positioned above an upper end of the first tubular fitting and an upper end of the second tubular fitting.

16. A connector unit as in claim 1 wherein the sleeve further defines a generally frustoconical downwardly facing inner surface near the lower end of the sleeve; and each collet finger defines a generally frustoconical upwardly facing outer surface between the upper end and the lower end of each collet finger;

the generally frustoconical downwardly facing inner surface near the lower end of the sleeve contacting the generally frustoconical upwardly facing outer surface of each collet finger when the connector unit is in the latched position.

17. A connector unit as in claim 1 further comprising a ring-shaped biasing means positioned circumferentially around an outer surface of the plurality of collet fingers near the upper end thereof.

18. A subsea tool having an external connector unit for connecting the tool to a shaft extending upwardly from equipment situated beneath the subsea tool, said tool comprising:

a tool body having an upper end, a lower end, and an axial passage extending therethrough, a connector unit mounted to the tool body for axially connecting to a linkage extending upwardly from the equipment situated beneath the subsea tool, wherein the connector unit comprises a shaft having an upper end, a lower end, a longitudinal axis, a generally cylindrical outside surface, and an annular groove defined in the generally cylindrical outside surface adjacent to the lower end of the shaft;

a plurality of collet fingers peripherally positioned against the generally cylindrical outside surface of the shaft adjacent to the lower end of the shaft, each collet finger having a radially inwardly extending upper ridge near an upper end of the collet finger which is positioned in the annular groove of the shaft and a radially inwardly extending lower ridge near a lower end of each collet finger which is positioned at a spaced apart distance beneath the lower end of the shaft;

a sleeve having an upper end, a lower end, and a generally cylindrical inside surface positioned peripherally around the shaft, an annulus being defined between the generally cylindrical inside surface of the sleeve and the generally cylindrical outside surface of the shaft, wherein a lower portion of the generally cylindrical inside surface of the sleeve contacts an outer face of each collet finger to retain the generally radially inwardly extending upper ridge on each collet finger in the groove on the shaft;

annular flange means radially positioned in the annulus to define an upper annular chamber between the generally cylindrical outside surface of the shaft and the generally cylindrical inside surface of the sleeve above the annular flange means and a lower annular chamber between the generally cylindrical outside surface of the shaft and the generally cylindrical inside surface of the sleeve below the annular flange means;

means for sealing an upper end of the upper annular chamber between the shaft and the sleeve, thereby forming an upper hydraulic chamber; and means for sealing a lower end of the lower annular chamber between the shaft and the sleeve, thereby forming a lower hydraulic chamber;

wherein the shaft further defines first hydraulic fluid passage opening into the upper hydraulic chamber and a second hydraulic fluid passage opening into the lower hydraulic chamber;

whereby supply of hydraulic fluid through one of the first hydraulic fluid passage or the second hydraulic fluid passage moves the sleeve from a first position in which the collet fingers are in an unlatched position with the lower ends of the collet fingers extending past the lower end of the sleeve to a latched position in which the lower ends of the collet fingers are positioned adjacent an inside surface of the sleeve.

19. A subsea tool as in claim 18 further comprising a hydraulic piston unit mounted on the outer surface of the tool body at a position vertically above the connector unit; and a connecting rod connecting the piston of the hydraulic piston unit with the upper end of the shaft.

20. A subsea tool as in claim 19 wherein the connecting rod further defines a first hydraulic fluid passage sealingly connected to the first hydraulic fluid passage of the shaft and a second hydraulic fluid passage sealingly connected to the second hydraulic fluid passage of the shaft.

21. A subsea tool as in claim 20 wherein the connecting rod extends through the piston of the hydraulic piston unit and has an upper end positioned above the hydraulic piston unit, wherein the first hydraulic fluid passage and the second hydraulic fluid passage open onto the upper end of the connecting rod.

22. A subsea tool as in claim 21 wherein the tool body has a generally cylindrical outside surface.

23. A subsea tool as in claim 22 further comprising a subsea christmas tree having a tubular main body having a longitudinal axis and including a linkage shaft positioned outside of the tubular main body parallel to the longitudinal axis;

said tubular main body and said linkage shaft each having an upper end, wherein the subsea tool is positioned on the upper end of the tubular main body, and the connector unit is attached to the upper end of the linkage shaft.

* * * * *

UNITED STATES PATENT AND TRADEMARK OFFICE

CERTIFICATE OF CORRECTION

PATENT NO. : 6,059,336
DATED : May 9, 2000
INVENTOR(S) : Meronek

It is certified that error appears in the above-identified patent and that said Letters Patent is hereby corrected as shown below:

Title page,
Item [73], please delete "Kvaetner", and insert -- Kvaerner --.

Signed and Sealed this

Fourth Day of December, 2001

*Attest:*

Nicholas P. Godici

NICHOLAS P. GODICI
*Acting Director of the United States Patent and Trademark Office*

*Attesting Officer*